US005381139A

United States Patent [19]

Bensimon

[11] Patent Number: 5,381,139

[45] Date of Patent: Jan. 10, 1995

[54] DETECTOR SYSTEM FOR A ROLL-STABILIZED AIRCRAFT

[75] Inventor: Joseph Bensimon, L'Hayes Les Roses, France

[73] Assignee: Societe Anonyme dite: Aerospatiale Societe Nationale Industrielle, Paris, France

[21] Appl. No.: 1,212

[22] Filed: Jan. 6, 1993

Related U.S. Application Data

[63] Continuation of Ser. No. 657,122, Feb. 19, 1991, abandoned.

[30] Foreign Application Priority Data

Mar. 16, 1990 [FR] France ..... 90 03410

[51] Int. Cl.[6] ..... G08B 21/00

[52] U.S. Cl. ..... 340/945; 244/3.16; 250/342; 348/146

[58] Field of Search ..... 340/961, 945; 358/109; 73/178 R; 244/3.16, 129.3; 102/213; 356/152; 250/334, 342, 347, 203.6, 206.2; 348/117, 144, 146

[56] References Cited

U.S. PATENT DOCUMENTS

| | | | |
|---|---|---|---|
| 2,873,381 | 2/1959 | Lauroesch . | |
| 3,924,826 | 12/1975 | Reinert | 244/129.3 |
| 3,942,446 | 3/1976 | Cruzan | 102/213 |
| 4,022,132 | 5/1977 | Blomqvist et al. | 102/213 |
| 4,044,251 | 8/1977 | Taylor et al. | 250/342 |
| 4,142,696 | 3/1979 | Nottingham . | |
| 4,193,688 | 3/1980 | Watkins . | |
| 4,527,158 | 7/1985 | Runnels | 356/152 |
| 4,755,818 | 7/1988 | Conrad | 340/961 |

FOREIGN PATENT DOCUMENTS

| | | |
|---|---|---|
| 1511643 | 5/1978 | United Kingdom . |
| 2162014 | 1/1986 | United Kingdom . |
| 2190177 | 11/1987 | United Kingdom . |
| WO8804400 | 6/1988 | WIPO . |

*Primary Examiner*—Brent Swarthout
*Attorney, Agent, or Firm*—Marshall, O'Toole, Gerstein, Murray & Borun

[57] ABSTRACT

A detector system for a roll-stabilized aircraft includes a hollow rotatable toroidal ring within which a suitable sensor such as a TV sensor is fixed. The sensor observes the exterior of the aircraft through an observation window in the outer peripheral wall of the ring, which can be rotated about the roll axis of the aircraft. The apparatus includes appropriate instrumentation for determining the position relative to the aircraft of an object detected by the sensor.

12 Claims, 7 Drawing Sheets

FIG. 1
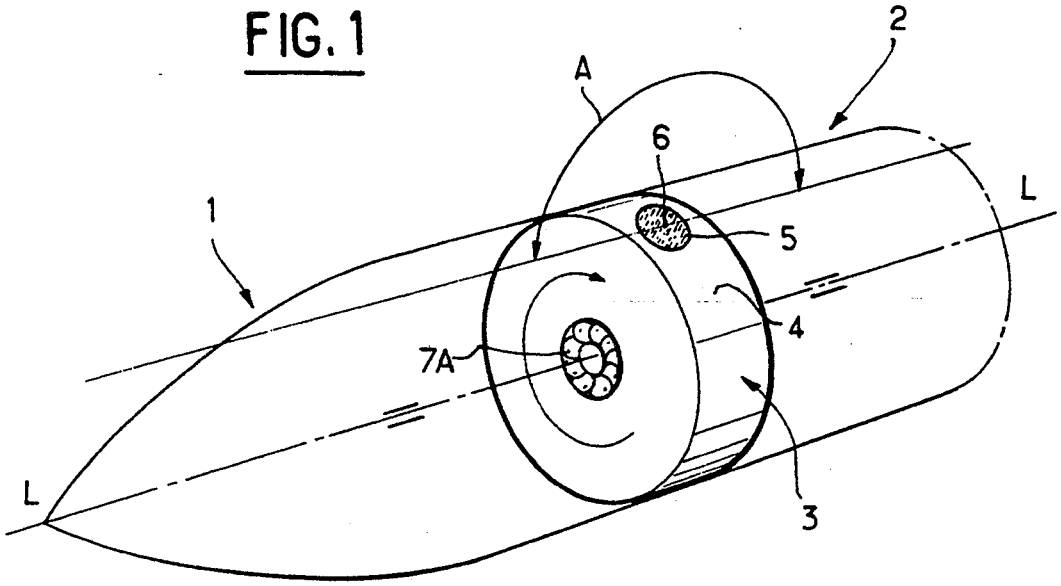
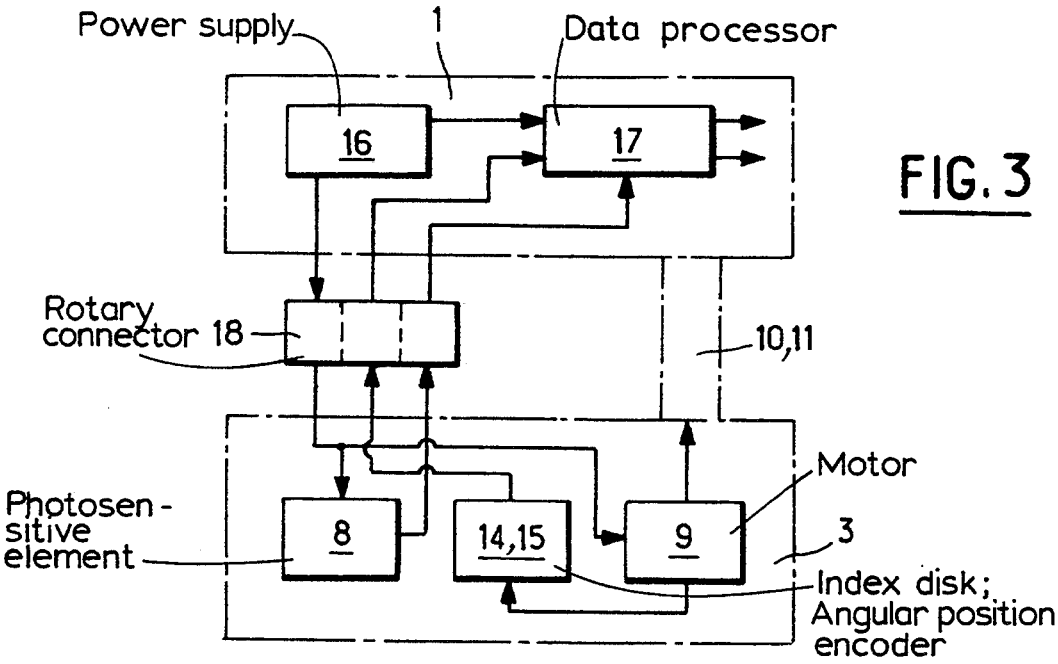
FIG. 3

FIG. 10
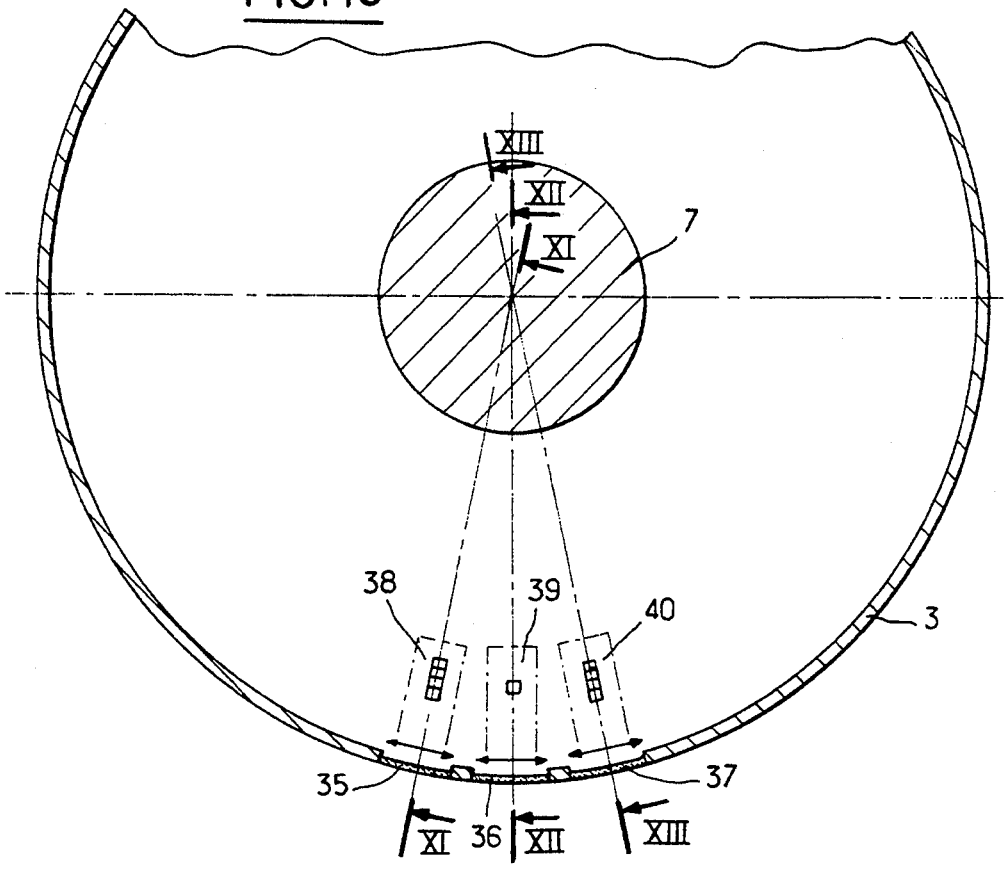
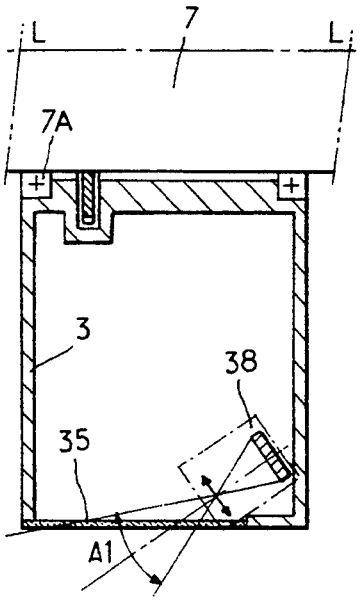
FIG. 11
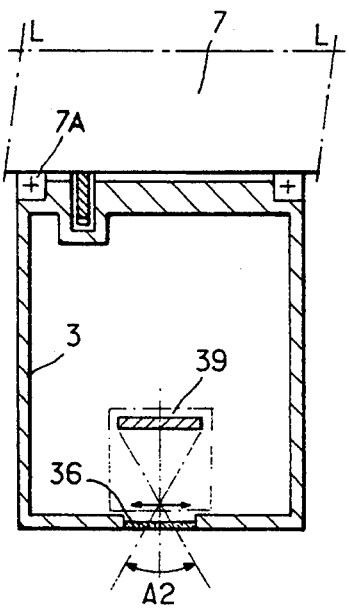
FIG. 12
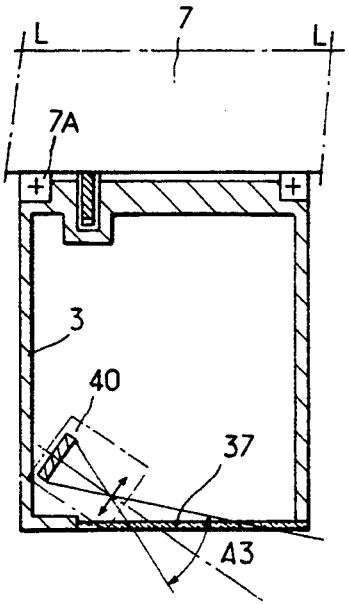
FIG. 13

DETECTOR SYSTEM FOR A ROLL-STABILIZED AIRCRAFT

This application is a continuation of application Ser. No. 07/657,122, filed Feb. 19, 1991, now abandoned.

The present invention relates to a detector system for a roll-stabilized aircraft.

BACKGROUND OF THE INVENTION

Modern aircraft are provided with detector systems for observing the terrain over which they are flying and/or for detecting enemy aircraft seeking to destroy them.

For example, American patent U.S. Pat. No. 4,543,603 describes a missile recognition system in which the observed field of view is scanned by rotating said missile about its roll axis. Such a system cannot be implemented in a missile which is roll-stabilized.

In contrast, American patent U.S. Pat. No. 3,942,446 relates to a system for detecting enemy aircraft for use on a roll-stabilized missile. In this prior system, rings of detectors are provided around the periphery of said missile. In order to enable them to cover the entire field of view around the roll axis of the missile, each ring includes a plurality of detectors. Such detector multiplicity gives rise to high system cost and to complex handling of the data provided by said detectors.

An object of the present invention is to remedy these drawbacks. The present invention relates to a detector system including a limited number of detectors and which is particularly, but not exclusively, suitable for use in a missile flying at high altitude to protect it from other missiles seeking to destroy it, e.g. ground-to-air or air-to-air missiles.

SUMMARY OF THE INVENTION

To this end, the present invention provides a detection system for a roll-stabilized aircraft, the detection system comprising:

- a hollow rotary ring suitable for rotating about the roll axis of said aircraft;
- means for rotating said ring about said roll axis;
- photosensitive means disposed inside said hollow rotary ring, constrained to rotate together therewith, and suitable for observing the environment around said aircraft through at least one observation window provided through the outer peripheral wall of said ring;
- measurement means indicating at all times the angular position of said ring about said roll axis; and
- processor means receiving the information delivered by said photosensitive means and by said measurement means.

Thus, by virtue of the field of view of said photosensitive means in a plane passing through the center of said window and including the roll axis of the aircraft, it is possible to perform bearing detection. In addition, because said plane rotates about the roll axis, detection is also obtained in elevation.

It can thus be seen That to obtain detection both in bearing and in elevation, it suffices for said photosensitive means to observe at least the field of view contained in the rotary plane including the center of said window and the roll axis of said aircraft.

In order to detect an enemy that may be in any position relative to the missile of the invention, it is advantageous for said rotary ring to rotate continuously about the roll axis of said aircraft. However, whenever the enemy missile must necessarily be on one particular side of the missile of the invention, it may suffice for said rotary ring to oscillate back-and-forth about the roll axis of said aircraft. This may apply, for example, when the missile of the invention flies at very high altitude and needs to look out for enemy missiles arriving from below.

Some of said drive means, photosensitive means, measurement means, and processor means, are fixed to said aircraft, while others of them are fixed to said rotary ring, such that a rotary connection device or the like is provided to deliver electrical power to said means and to interconnect them.

Although said ring may include a shaft which is rotatably supported by the aircraft, it is preferable for said rotary ring to rotate about a shaft which is fixed relative to said aircraft.

In which case, said aircraft is made up of two dismountable portions fitted together by means of said shaft. Thus, said rotary ring may be mounted on said shaft when said portions of the aircraft are disassembled. However, in a variant, it is the rotary ring which is made up of two parts that can be assembled about said shaft. This makes it possible for said aircraft to be constituted as a single piece.

In one embodiment, the peripheral wall of said rotary ring is flush with the outside face of the skin of said aircraft. However, in this case, slots appear on either side of said ring, i.e. discontinuities appear, and these may give rise to undesirable aerodynamic effects. It is thus preferable for the peripheral wall of said rotary ring to be set back from the outside face of the skin of said aircraft, and for the portion of said skin facing said rotary ring to be made at least in part of a material which is transparent to the radiation to which said photosensitive means are sensitive. In this way, the outside face of the aircraft skin can be continuous. When the rotary ring rotates continuously about said roll axis, said material transparent to the radiation constitutes a full ring in said aircraft skin. In contrast, if the rotary ring is driven with reciprocating back-and-forth motion, then said transparent material may occupy only a segment of a ring in the aircraft skin, with the segment corresponding to the maximum stroke of the rotary ring.

In an advantageous embodiment, said window includes a fish eye type objective lens enabling it to cover a 180° field of view in the rotary plane including the center of said window and the roll axis of said aircraft.

However, in a variant embodiment, said photosensitive means are constituted by a plurality of individual detectors, each individual detector being associated with a respective observation window, and The field of view scanned by each individual detector-window pair constituting a portion of the total field of view lying in the rotary plane including the center of said window and the roll axis of said aircraft.

BRIEF DESCRIPTION OF THE DRAWINGS

Embodiments of the invention are described by way of example with reference to the accompanying drawings, in which:

FIG. 1 is a diagram of a missile of the invention with the outline of the missile being represented by dot-dashed lines while the rotary ring included therein is shown using solid lines;

FIG. 3 is a block diagram illustrating the detection system of the invention, including both its portion fixed to the missile and its portion fixed to the ring;

FIG. 10 is a section through the ring of the system shown in FIG. 9 on a plane orthogonal to the roll axis of the missile;

FIGS. 11, 12, and 13 correspond respectively to sections on lines XI—XI, XII—XII, and XIII—XIII of FIG. 10.

DETAILED DESCRIPTION

Figure 2:
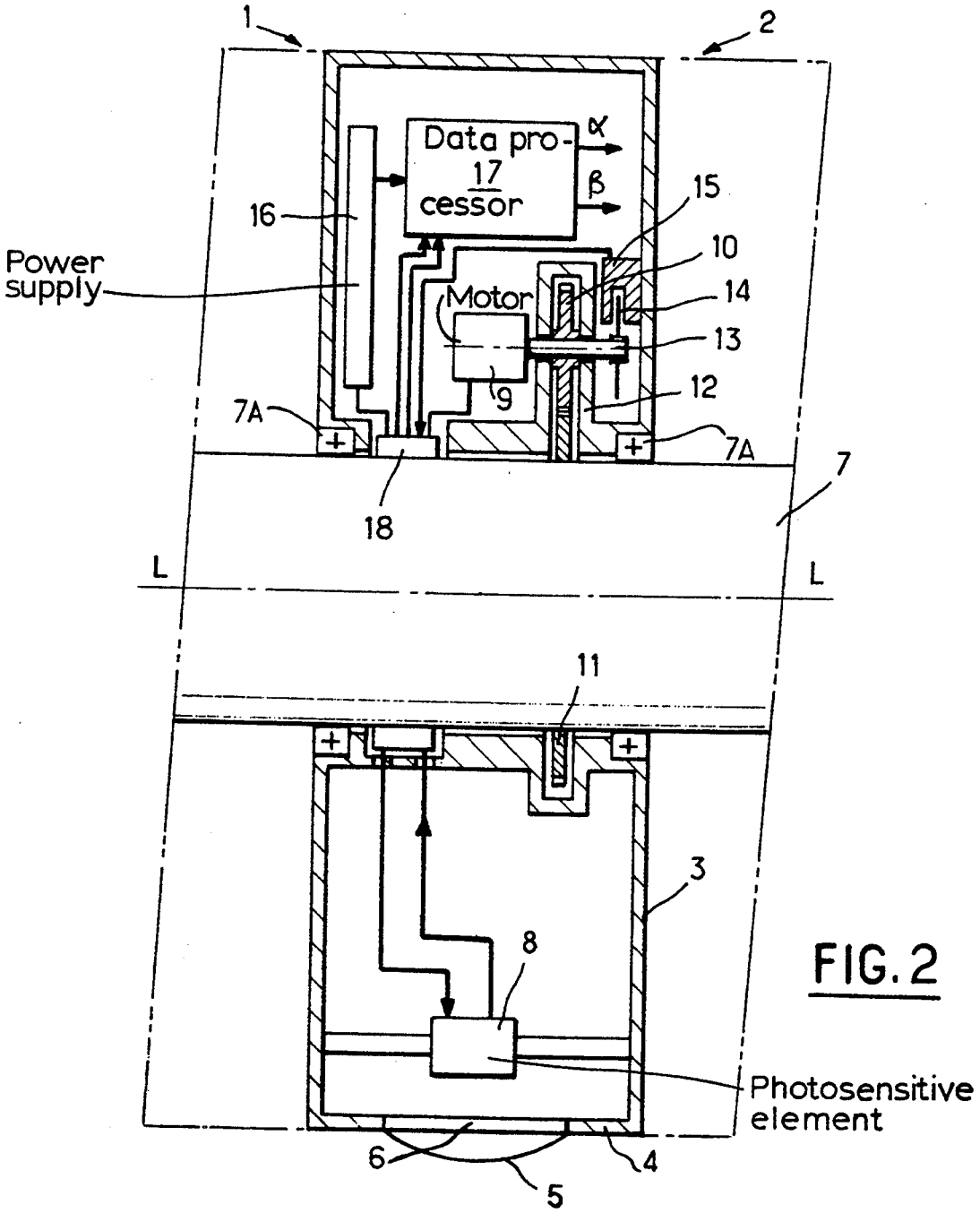
FIG. 2 is a diametrical section on a plane including the roll axis of the missile and it shows the ring of FIG. 1.

In the figures, identical references designate similar items.

The missile 1 shown diagrammatically in FIG. 1 is roll stabilized about its longitudinal or "roll" axis L—L.

Inside its cylindrical portion 2, the missile 1 includes a hollow rotary ring 3 capable of rotating about said roll axis L—L. To this end, the ring 3 includes ball bearings 7A close to its center. In its outer peripheral wall 4, the ring 3 includes an observation window 5 having a center 6.

As can be seen in FIG. 2, the ring 3 is rotatably mounted by means of the ball bearings 7A on a shaft 7 which is fixed to the missile 1. Photosensitive means 8 are provided inside the hollow ring 3 and are disposed to look through the observation window 5. The photosensitive means 8 may be constituted, for example, in the form of strips or arrays of CCD type photosensitive elements which are sensitive to infrared radiation. These photosensitive means are constrained to rotate with the ring 3. For the purpose of driving it about the shaft 7, the ring includes a motor 9 constrained to rotate with said ring and itself rotating a gear wheel 10 that meshes with a toothed wheel 11 fixed to the shaft 7. The shaft 13 of the motor 9 on which the gear wheel 10 is keyed rotates inside a housing 12 which is fixed to the rotary ring 3. In addition, the shaft 13 is fixed to an index disk 14 which cooperates with an angular position encoder 15 that is fixed to the ring 3.

An electrical power supply circuit 16 fixed relative to the missile 1 is provided to power the photosensitive means 8, the motor 9, and a data processing device 17, said device 17 being fixed relative to the missile 1.

A rotary connection or slip ring device 18 is provided to enable the photosensitive means 8 and the motor 9 to be powered from the power supply circuit 16 and also to transmit information from the photosensitive means 8 and the encoder 15 to the processor device 17. FIG. 3 is a block diagram showing the power supply and data transmission links between the devices 16 and 17 which are connected directly to the missile 1 and the devices 8, 9, 14, and 15 which are connected to the rotary ring 3. These connections are shown to pass through the rotary connection device or the like 18, with the ring 3 being connected to the missile 1 via its rotary drive connection 10, 11.

The motor 9 is controlled to rotate the ring 3 about the axis L—L either continuously over 360°, or else to reciprocate back-and-forth about a mean position through an angular amplitude of not more than 180°.

The photosensitive means 8 are disposed in such a manner as to cover a field of view A (see FIG. 1) having an aperture angle as close as possible to 180° in an axial plane passing through the center 6 of the observation window 5 and including the roll axis L—L.

Figure 4:
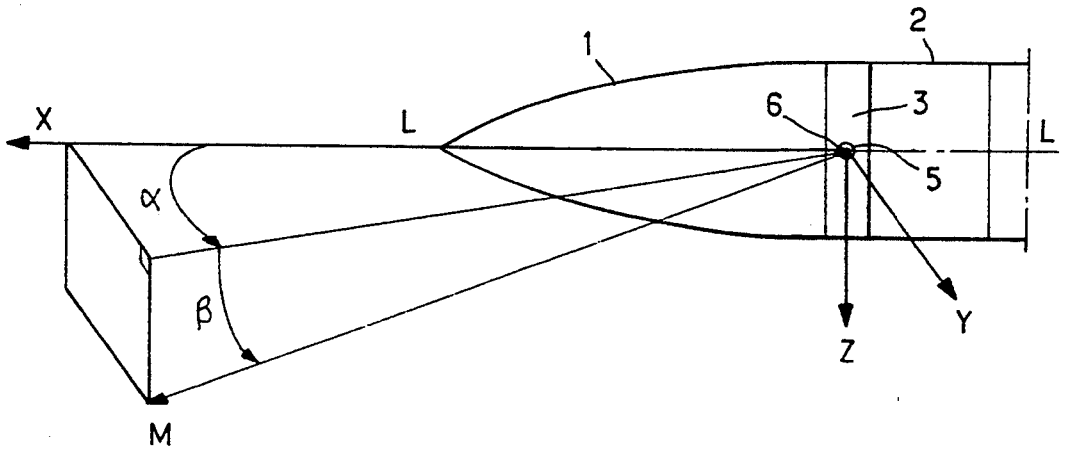
FIG. 4 illustrates how the system of FIGS. 1 to 3 operates.
Figure 9:
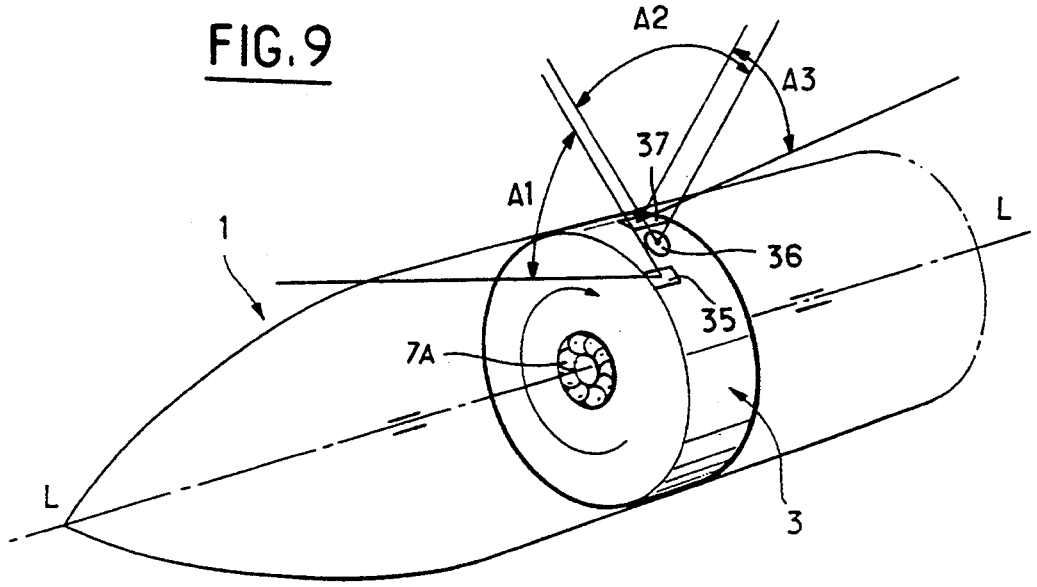
FIG. 9 is a view identical to FIG. 1 showing a variant embodiment of the rotary ring.

Since this field of view A is rotated about the roll axis L—L when the ring 3 rotates, the field of view A scans either the entire environment around the missile 1 (continuous rotation of the ring 3), or else a portion of said environment (reciprocating rotation of said ring Consequently, as shown in FIG. 4, the computer 17 receiving information from the photosensitive means 8 and the angular position encoder 14, 15 is capable of determining the coordinates of any missile M to be found around the missile 1, e.g. in the form of angular coordinates $\alpha$ and $\beta$ as shown in FIG. 4. The photosensitive means 8 give the position of the missile M within the field of view A while the encoder 14, 15 indicates the position of the field of view A about the axis L—L.

Figure 5A:
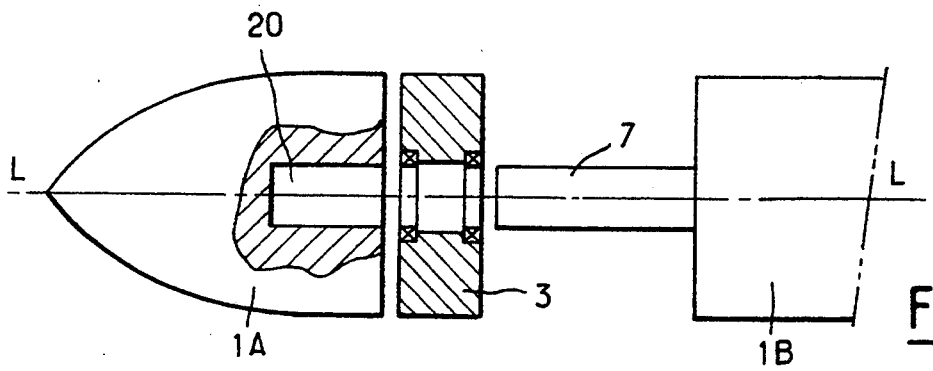
FIGS. 5A and 5B show two ways in which the rotary ring can be mounted on the missile.
Figure 5B:
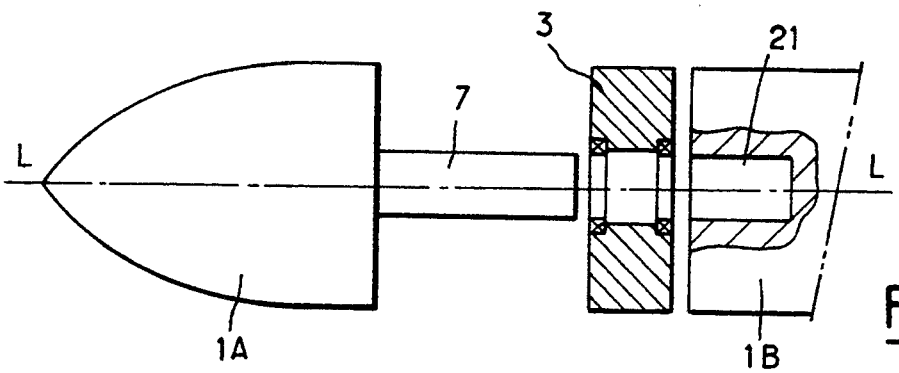

In FIGS. 5A and 5B, it is assumed that the missile 1 is built up from two separable subassemblies 1A and 1B which are assembled together by means of the shaft 7. In FIG. 5A, the shaft 7 is fixed to the cylindrical portion 1B and is suitable for penetrating into a recess 20 provided in the conical portion 1A. In contrast, in FIG. 5B, it is assumed that the shaft 7 is fixed to the conical per, ion 1A and is suitable for being received in a recess 21 in the cylindrical portion 1B. In both cases, it can be seen that the ring 3 is easily placed on the shaft 7 prior to assembling together the two portions 1A and 1B.

Figure 6A:
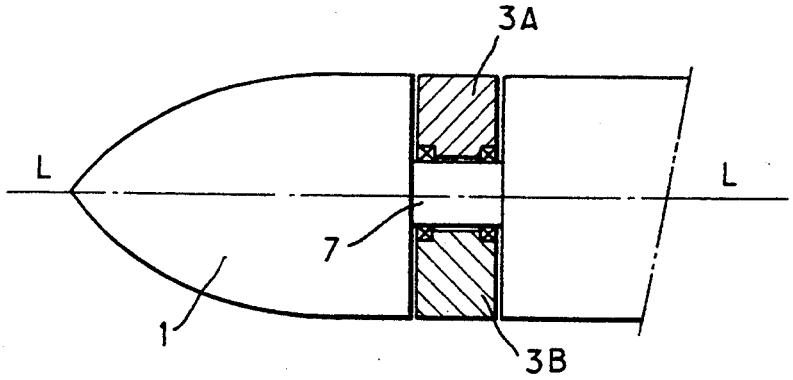
FIGS. 6A and 6B show a variant way of mounting the ring on the missile.
Figure 6B:
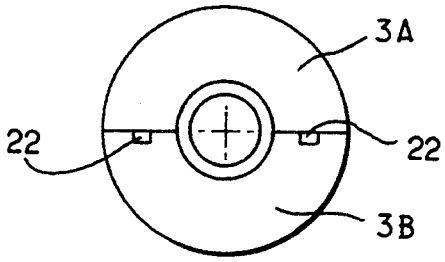

In contrast, in FIGS. 6A and 6B it is assumed that the missile 1 comprises a single piece while the ring 3 is built up from two half-rings 3A and 3B which are assembled together diametrically by means 22. In this case, it can be seen that the ring is easily installed on the shaft 7 and assembled thereto by means of the device 22.

Figure 7A:
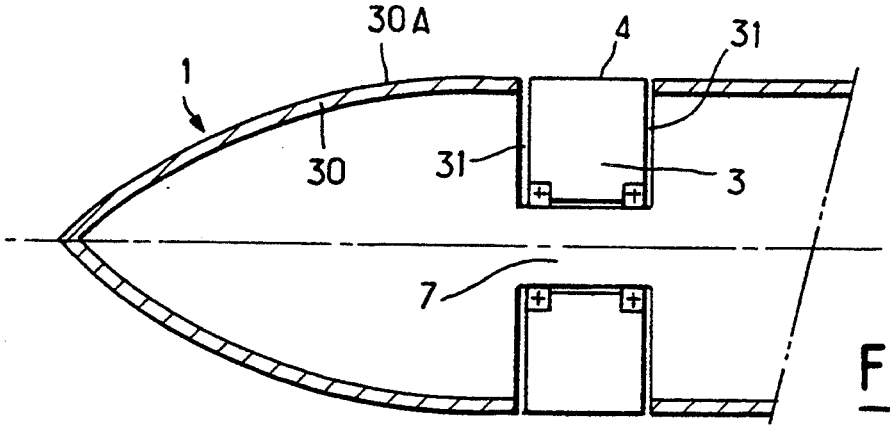
FIGS. 7A, 7B, and 7C show variant dispositions of the rotary ring in the missile.
Figure 7B:
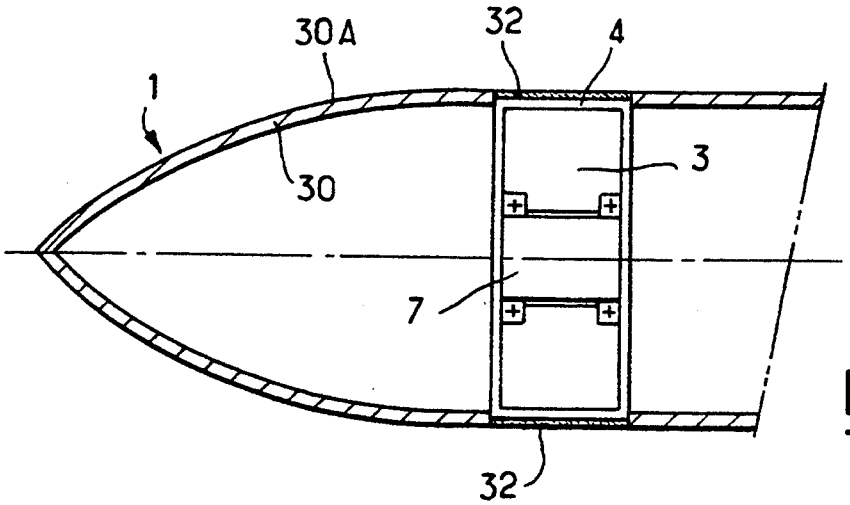
Figure 7C:
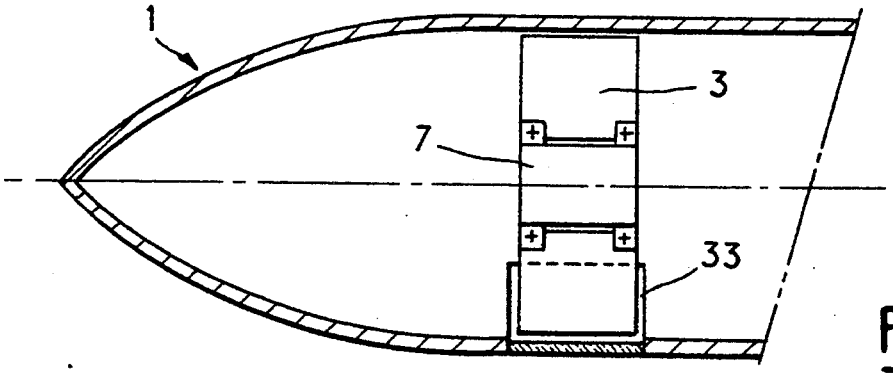

FIG. 7A shows an embodiment of the system of the present invention in which the outer peripheral wall 4 of the ring 3 is flush with the outside face 30A of the skin 30 of the missile 1. In this case, it can be seen that transverse slots 31 appear on either side of the rotary ring 3. In order to avoid such slots 31 and ensure aerodynamic continuity for the missile, FIGS. 7B and 7C show an embodiment in which the outer peripheral wall 4 of the ring 3 is set back from the outside wall 30A of the missile skin 30. In this case, the portion 32 of the skin 30 overlying the ring 3 is constituted by a shell transparent to the radiation to which the photosensitive elements 8 are sensitive. Depending on whether the ring 3 scans continuously or back-and-forth, the shell either constitutes a complete ring 32 as shown in FIG. 7B, or merely a fraction of a ring 33, as shown in FIG. 7C.

Figure 8:
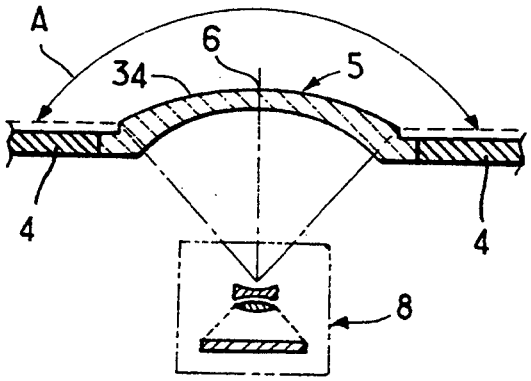
FIG. 8 is a cross-section through the observation window provided in the rotary ring.

As can be seen in FIG. 8, it is advantageous for the observation window 5 to be constituted by an objective lens 34 constituting a fish eye, thereby enabling the field of view A to cover 180°.

In the embodiment shown in FIGS. 9 to 13, a plurality of observation windows 35, 36, and 37 are provided in the outer peripheral wall 4 of the ring 3. Each of these observation windows 35, 36, and 37 is associated with respective photosensitive means referenced 38, 39, and 40.

Window 35 and associated photosensitive means 38 look towards the front of the missile to cover a fraction A1 of the field of view A. Similarly, window 37 and photosensitive means 40 look towards the rear of the missile to cover a fraction AS of the field of view A. Finally, window 36 and photosensitive means 39 look out over the middle portion A2 of the field of view A. Thus, in this case, the major portion of the field of view A is scanned by combining information delivered by the photosensitive means 38, 39, and 40.

Although the above description assumes that the invention is applied to a missile 1, the detection system of the present invention is naturally applicable to all other types of aircraft.

Figure 14:
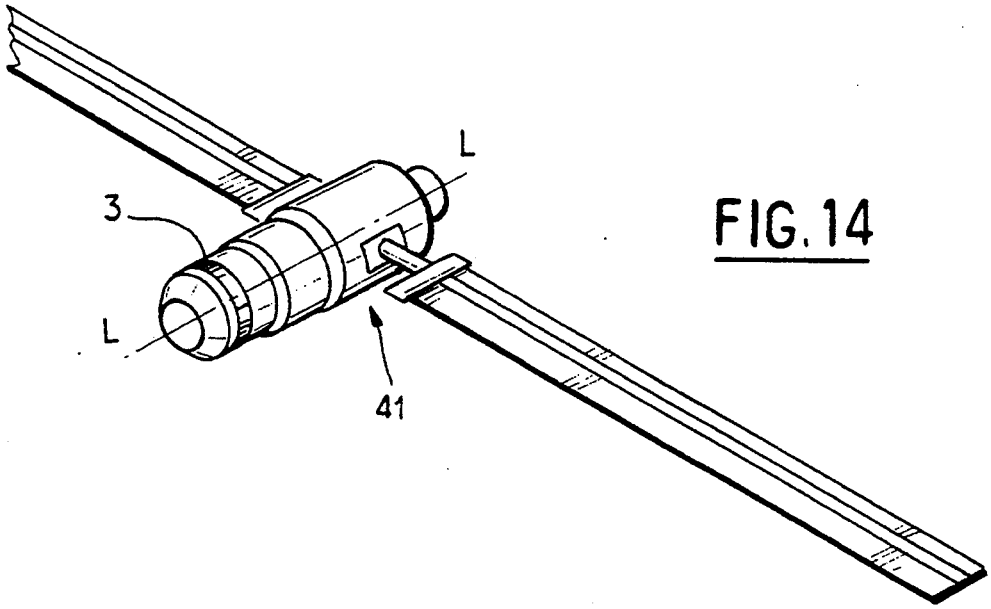
FIGS. 14, 15, and 16 show the system of the present invention mounted respectively on a satellite and on two different aircraft.
Figure 15:
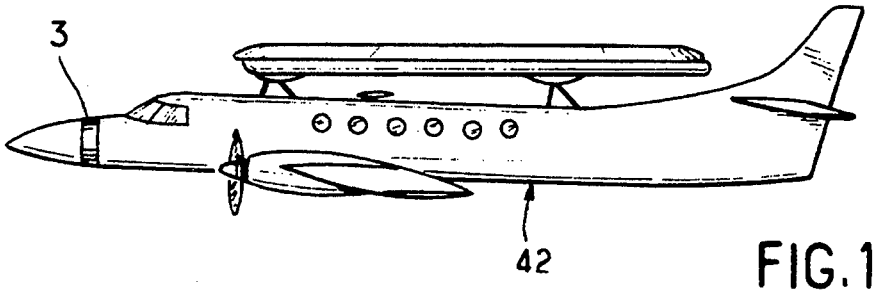
Figure 16:
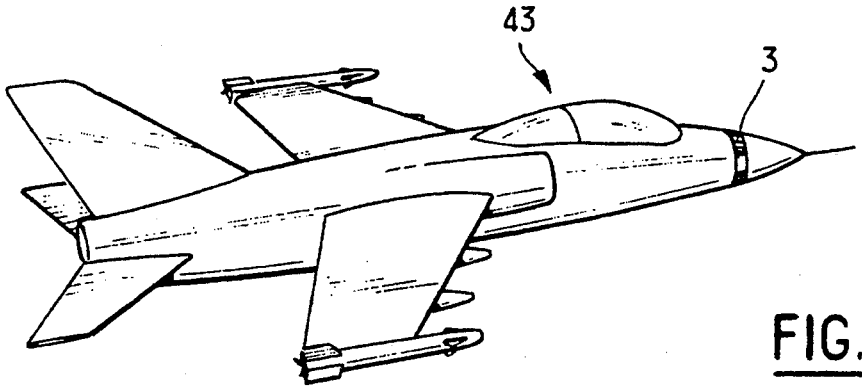

For example, FIG. 14 shows an artificial satellite 41 including a rotary ring 3 as described above and rotating about the satellite roll axis L—L. Similarly, FIGS. 15 and 16 show respectively an observation aircraft 42 and a combat aircraft 43 each including a respective rotary ring 33 disposed to rotate about its roll axis.

I claim:

1. A detection system for a roll-stabilized aircraft having a roll axis, comprising:

a hollow rotatable ring adapted to rotate about the roll axis of said aircraft, said ring being defined by an outer peripheral, generally cylindrical wall substantially flush with an outer surface of the aircraft, an inner generally cylindrical wall spaced from said outer wall which rotates around an inner surface of the aircraft, and a pair of parallel spaced planar walls perpendicular to said roll axis and intersecting said outer and inner cylindrical walls to enclose a toroidal volume within the ring;

means disposed within the toroidal volume defined by the inner, outer and planar walls of said hollow ring for rotating said ring about said roll axis;

photosensitive means disposed inside said ring, rotatable together therewith and suitable for observing and delivering information on the environment around said aircraft through the outer peripheral wall of said ring, said observation window being rigidly fixed to said outer peripheral wall of said ring and observing a field of view of at least about 180°;

measurement means indicating at all times the angular position of said ring about said roll axis and delivering information on said angular position; and processor means receiving the information delivered by said photosensitive means and by said measurement means.

2. A system according to claim 1, wherein said photosensitive means observe at least the field of view contained in a plane including the center of said window and the roll axis of said aircraft.

3. A system according to claim 1, wherein said rotary ring rotates continuously about the roll axis of said aircraft.

4. A system according to claim 1, wherein said rotary ring oscillates about the roll axis of said aircraft.

5. A system according to claim 1, wherein some of said means for rotating said ring, said photosensitive means, said measurement means, and said processor means, are fixed to said aircraft while others of them are fixed to said rotary ring, and wherein a rotary connection device is provided to deliver electrical power to and to interconnect said means for rotating said ring, said photosensitive means, said measurement means, and said processor means.

6. A system according to claim 1, wherein said rotary ring rotates about a shaft fixed to said aircraft.

7. A system according to claim 6, wherein said aircraft is made up of two dismountable portions fitted together by means of said shaft.

8. A system according to claim 6, wherein said rotary ring is made up of two portions suitable for assembly around said shaft.

9. A system according to claim 1, wherein the peripheral wall of said rotary ring is flush with the outside face of the skin of said aircraft.

10. A system according to claim 1, wherein the peripheral wall of said rotary ring is set back from the outside face of the skin of said aircraft, and wherein the portion of said skin facing said rotary ring is made at least in part of a material which is transparent to radiation to which said photosensitive means are sensitive.

11. A system according to claim 1, wherein said window includes a fish eye type objective lens enabling it to cover a field of view of 180° in a plane including the center of said window and the roll axis of said aircraft.

12. A system according to claim 1, wherein said photosensitive means are constituted by a plurality of individual detectors each having a field of view, wherein each of said individual detectors is associated with a respective observation window, and wherein the fields of view scanned by said individual detectors are combined to form a total field of view.

* * * * *

UNITED STATES PATENT AND TRADEMARK OFFICE

CERTIFICATE OF CORRECTION

PATENT NO. : 5,381,139

DATED : January 10, 1995

INVENTOR(S) : Joseph Bensimon

It is certified that error appears in the above-identified patent and that said Letters Patent is hereby corrected as shown below:

Column 4, line 20, "ring" should be --ring 3).--

Col. 4, lines 36 & 37, "per,ion" should be --portion--

Column 5, line 10, "AS" should be --A3--

Signed and Sealed this

Nineteenth Day of September, 1995

*Attest:*

Bruce Lehman

BRUCE LEHMAN

*Attesting Officer*

*Commissioner of Patents and Trademarks*